US005394836A

United States Patent [19]

Lastein

[11] Patent Number: 5,394,836

[45] Date of Patent: Mar. 7, 1995

[54] METHOD AND SYSTEM FOR TREATMENT OF LARGER ANIMALS

[76] Inventor: Johan Lastein, Jelsskovvej 2, DK-6630 Roedding, Denmark

[21] Appl. No.: 804,245

[22] Filed: Dec. 9, 1991

[51] Int. Cl.[6] ..... A61D 11/00

[52] U.S. Cl. ..... 119/843; 119/158; 280/46

[58] Field of Search ..... 119/96, 103, 158, 82, 119/727, 753, 843, 848; 280/31, 43, 2, 46

[56] References Cited

U.S. PATENT DOCUMENTS

| | | | |
|---|---|---|---|
| 2,595,781 | 5/1952 | Dusham | 119/159 |
| 2,808,031 | 10/1957 | Sollars et al. | 119/158 |
| 3,130,979 | 4/1964 | Valiquette | 280/30 |
| 3,734,058 | 5/1973 | Hightower et al. | 119/3 |
| 3,796,191 | 3/1974 | McIntire | 280/30 |
| 3,945,661 | 3/1976 | Preifert | 280/46 |
| 4,112,874 | 9/1978 | Forrest | 119/158 |
| 4,165,096 | 8/1979 | Lewis, Jr. et al. | 280/43 |
| 4,332,217 | 6/1982 | Davis | 119/158 |
| 4,392,687 | 7/1983 | O'Connell | 280/30 |
| 4,561,423 | 12/1985 | Blasey | 126/425 |
| 4,947,025 | 8/1990 | Alston et al. | 219/303 |

FOREIGN PATENT DOCUMENTS

4386/82 10/1982 Denmark .

*Primary Examiner*—Gene Mancene
*Assistant Examiner*—Todd E. Manahan
*Attorney, Agent, or Firm*—Antonelli, Terry, Stout & Kraus

[57] ABSTRACT

A method and system is provided for treatment of large animals such as down cows, that is, cows which, due to physiological disorders, are unable to raise themselves. A drag mat, made from strong rubber, is placed next to the down animal, and the animal is rolled onto the drag mat. A treatment tank, having removable end door plate members is positioned in front of the down animal, and a ramp is placed nearest the head of the down animal. The drag mat, with the animal thereon, is pulled into the treatment tank by a tractor or a truck. The end door plate members are replaced and sealed to form a watertight sealed tank. Preferably, warm water is filled into the treatment tank for assisting the animal in raising itself.

4 Claims, 4 Drawing Sheets

METHOD AND SYSTEM FOR TREATMENT OF LARGER ANIMALS

FIELD OF THE INVENTION

The present invention relates to a system and method for treatment of larger animals such as down cows, that is cows which, due to a physiological disorder, are not able to raise themselves.

BACKGROUND OF THE INVENTION

The cattle disease "milk fever" may cause a paralysis of the hind legs of cows and, under those conditions, the cow will naturally be lying down and be unable to raise itself. Paralysis may also be caused by birth-problems and, to prevent the paralysis from permanently damaging the cow, it is important that some physiological treatment of the effected hind part of the cow is begun as soon as possible.

Furthermore, a down cow may be the result of the cow sliding on a smooth and moist surface or even when the cow splits and strains the muscles of the hind thigh. However, the necessary treatment is rather difficult to carry out when the cow is lying down and particularly, if the cow is lying in a field or in the bush.

Previously, use was made of a so-called hip-clamp which was placed around the hips of the cow for raising the cow by a suitable hoist. However, the use of hip-clamps have been forbidden because the cow suffered terribly by injuring the hip muscles. Alternatively, use was made of a special sling which was placed around the hind part of the cow, but, in practice, it is certainly difficult to get such a sling on a down cow.

Consequently, such down cows have caused financial troubles for farmers because, in most cases, it has been necessary to put down the cow in the field which normally means that it is not even possible to utilize the meat.

On the other hand, cows and heifers are often very valuable breeding animals and, in practice, most farmers are ready to offer a relatively large amount of money in order to save the cow or heifer.

SUMMARY OF THE INVENTION

The present invention has for its purpose the provision of a method for treatment of down cows and by means of which it, by simply provisions, is possible to save down cows by getting the down cows back on their legs.

The method according to the present invention is distinctive in that a towing mat, preferably made from rubber, is placed next to the down cow, the cow is rolled onto the mat, and a treatment tank having doors at opposite ends thereof are removed and is positioned in front of the cow in such a manner that a ramp of the tank is placed nearest the head of the cow. The mat, with the cow on the mat, by a tractor or truck, is pulled into the treatment tank. Both end doors are replaced to make the tank a water tight sealed tank and, preferably, warm water is filled into the treatment tank for assisting the cow in raising herself.

By virtue of the features of the present invention, a method for treatment of down cows is provided by which, in most cases, it may be possible to save the down cows. The lifting ability of the water in the treatment tank relieves the legs of the down cow from the full weight of the body and, in most cases, it is sufficient to assist the cow in getting on its own legs again. A halter is placed around the head of the cow to assist the cow in keeping her head above the water while filling the treatment tank. The very free straightening of the legs counts as a real treatment; but, of course, it would be possible to further manipulate the legs or hind part of the cow.

Preferably, the method according to the invention is carried out by a treatment tank which is built on a trailer in such a manner that the treatment tank may assume either a transport position where the tank is lifted from the ground of a working position wherein the tank is supported on the ground.

Advantageously, according to the invention the treatment tank is transportable to a location accessible to warm water and level terrain prior to filling warm water in the treatment tank.

When the cow, after treatment, by herself exits the treatment tank it is important that the cow has extremely good footing so that she does not slip or do the splits.

The invention also relates to a system for treatment of larger animals such as down cows, that is, cows which, due to physiological disorders, are not able to raise themselves, with the system comprising a drag mat adapted to be placed on the ground next to a down cow for enabling a rolling of the cow onto the drag mat, and a ramp adapted to be placed in front of the head of the cow between the ground surface and a narrow end edge of the planar bottom surface of the treatment tank which, at opposite narrow ends, is provided with door openings in which separate door plates may be mounted for a water-tight sealing for the treatment tank when the cow on the drag mat is pulled into the treatment tank which, preferably, is provided with a valve means for discharging water from the treatment tank.

Preferably, the system according to the present invention further comprises a water heater (boiler) unit which, preferably, is built on a trailer and is adapted to supply warm water to the treatment tank.

Preferably, according to the present invention, the treatment tank is provided with mutually parallel and upright side walls which, at opposite end edges, are provided with sealing means, and loose door plate members at opposite end edges are also provided with sealing means.

In order to make the system mobile and easy to operate, advantageously, the treatment tank is built on a trailer in such a manner that the treatment tank may assume either a transport position in which the tank is lifted from the ground or a working position in which the tank is supported on the ground.

According to the invention, supporting wheels of the treatment tank trailer are mounted on girders forming part of a trailer system in such a manner that the wheels are positioned at some distance in front of pivot points for rearmost ends of the girders, with the front ends being connected by a cross bar with a central connection bar adapted to be coupled to a tractor or truck. Fixing means are provided between the girders and the tank sides in order to secure the girders either in a working position where the treatment tank is supported on the ground or in a transport position wherein the treatment tank is lifted from the ground. Pivot axes for executing the lifting movement by lowering the trailer system is formed by the axes of the supporting wheels.

In accordance with further features of the present invention, locking means are provided at both ends of the treatment tank and at both sides thereof, with the locking means including a substantially vertical latch bar which, at one side, has a central projecting latch with an open slot adapted to receive a tightening bolt, a basic end part of which is pivotally secured at an outer side of the tank, while a threaded free end of the bolt is provided with a locking handle by which the latch bar may be rotated about its own axis. The latch bar at the opposite side comprises a plurality of projecting latches adapted to be inserted into open ends of outer transverse profile members of the door plate member so that the sealing means at the respective side edges of the door plate member, by the tightening handle, may be forced against the sealing means at the respective end edges of the treatment tank.

Preferably, the system of the present invention also comprises a wheel-supported cattle stretcher adapted to be used when fetching a down cow out of a cattle shed.

BRIEF DESCRIPTION OF THE DRAWINGS

The above and other objects, features and advantages of the present invention will become more apparent from the following description when taken in connection with the accompanying drawings which show, for the purpose of illustration only, one embodiment in accordance with the present invention, and wherein.

DETAILED DESCRIPTION

Figure 1:
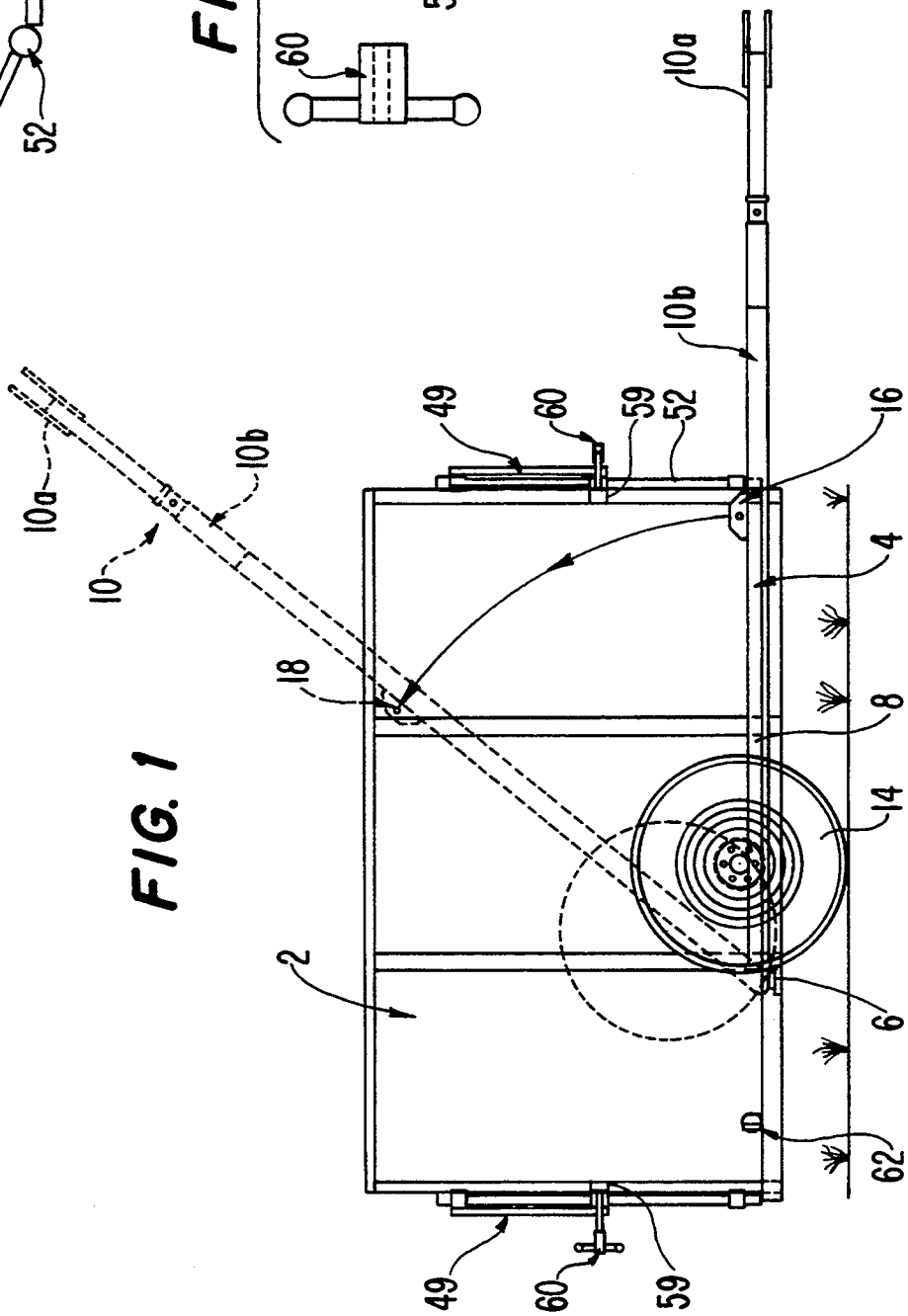
FIG. 1 is a right side elevational view of an embodiment of a wheel-supporting treatment tank constructed in accordance with the present invention.

Referring now to the drawings wherein like reference numerals are used throughout the various views to designate like parts and, more particularly, to FIG. 1, according to this Figure, a treatment tank generally designated by the reference numeral 2 is mounted on a trailer chassis generally designated by the reference numeral 4 in such a manner that the treatment tank 2 may either be positioned in a transport position, shown in full lines, or in a working position supported on the ground, shown in phantom lines.

The treatment tank 2 in the transport position is moved to a location where a down cow to be treated. The treatment tank 2 is pivotally mounted between rearmost ends 6 of carrying beams 8 of the trailer chassis 4 in such a manner that a pulling tongue arm system generally designated by the reference numeral 10 of the trailer chassis 4 may be used as a lever supported by wheels 14 on the ground. The pulling tongue arm system 10, as apparent from FIG. 1, includes a towbar section 10*a* and a further section including arms 10*b* adapted to be disposed at opposite sides of the treatment tank 2. After removal of locking pins from locking holes 16, the pulling tongue arm system 10 is swung rearwardly and upwardly for lowering the treatment tank 2 to the ground supported working position in which carrying beams 8 and the pulling tongue arm system 10 are again secured by insertion of the locking pins in locking holes 18. Preferably, the treatment tank 2 should now be placed in the ground-supported working position, with the rear end of the treatment tank 2 being near the head of the down cow.

Figure 3:
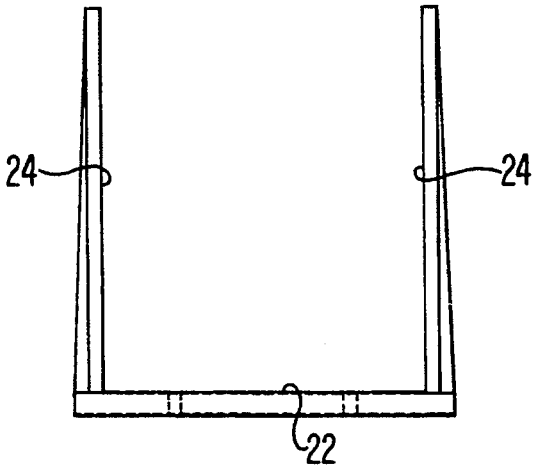
FIG. 3 is a schematic end view of the treatment tank of FIG. 2.
Figure 4:
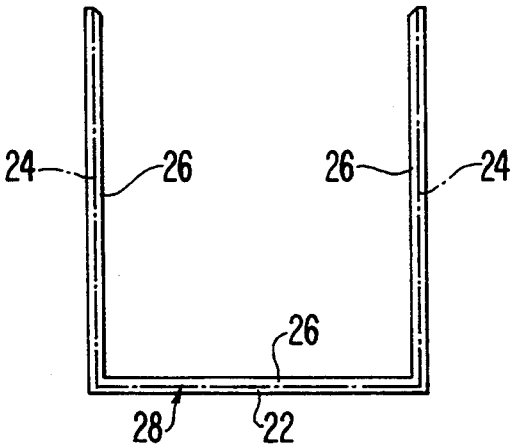
FIG. 4 is a schematic view of a flat frame member adapted to be welded to ends of the treatment tank for a door water seal.
Figure 5:
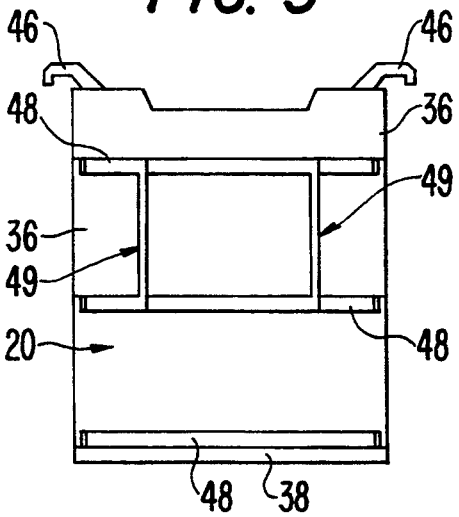
FIG. 5 is an elevational view of a door of the tank of the present invention.

Door plate members generally designated by the reference numeral 20 (FIG. 5) are removed from both ends of the treatment tank 2, with the open cross section of the tank being most clearly shown in FIG. 3. The treatment tank 2 has a smooth bottom surface 22 and smooth inner wall surfaces 24. In order to provide engagement edge flanges 26 for the door plate members 20 at both ends of the treatment tank 2, flat U-shaped frame members, shown in FIG. 4, are welded to both end surfaces of the treatment tank 2 of which the bottom surfaces 22 and inner wall surfaces 24 are indicated by dot-and-dash lines in FIG. 4.

Figure 2:
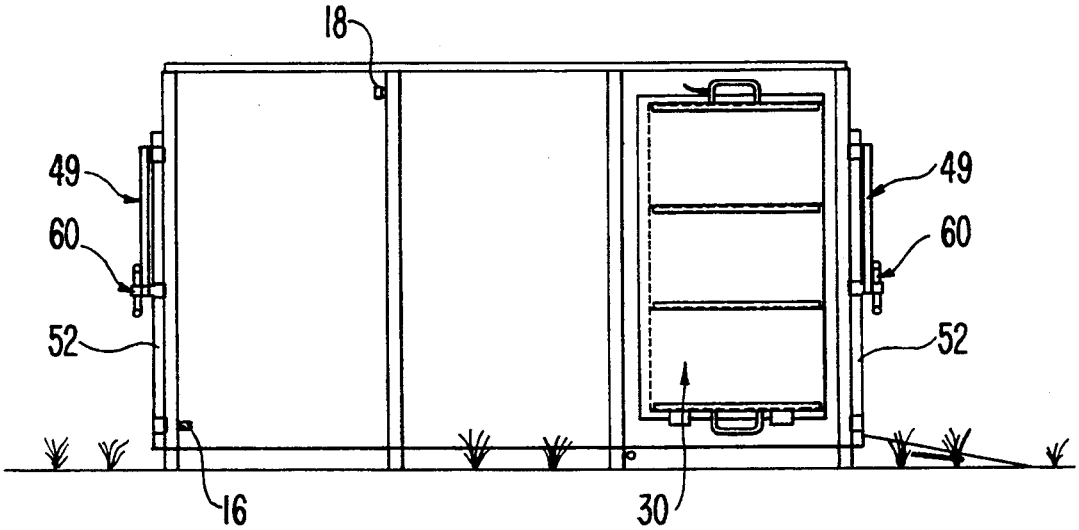
FIG. 2 is a left side elevational view of treatment tank of FIG. 1 placed on the ground.
Figure 9:
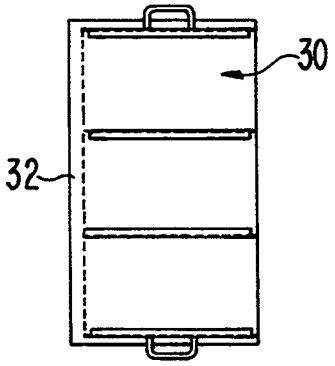
FIG. 9 is a top view of a ramp of the tank constructed in accordance with the present invention.
Figure 10:
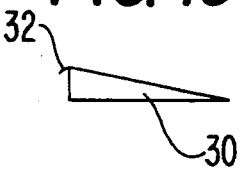
FIG. 10 is a side view of the ramp of FIG. 9.

A ramp 30 (FIGS. 9, 10) which may, for example, have a storage position on, for example, the left side of the treatment tank 2 (FIG. 2) is placed at the open rear end of the bottom surface 22 of the treatment tank 2, with a bent connection flange plate 32 being positioned over the lower engagement edge flange 26 of the treatment tank 2.

Figure 11:
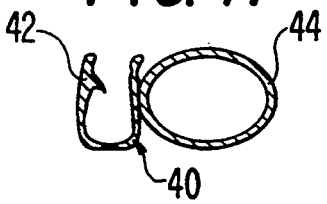
FIG. 11 is a cross-sectional view of a sealing list member adapted to be mounted on door edges for watertight sealing of the treatment tank of the present invention.
Figure 12:
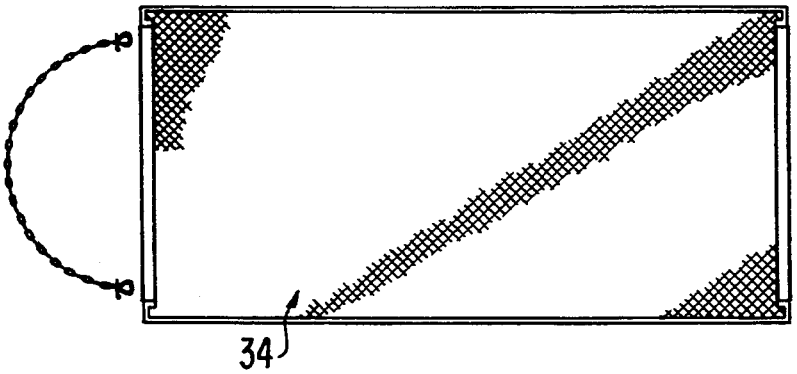
FIG. 12 is a plan view of a draw mat for use when pulling a down cow into the treatment tank of the present invention.

The ramp 30 is removed from the side of the treatment tank 2 and both the door plate members 20 are replaced in order to water tightly seal the treatment tank 2. Side edges 36 and the lower edge 38 of the door plate members 20 are provided with sealing strip members generally designated by the reference numeral 40, the cross section of which is shown in FIG. 11. The sealing strip member 40 comprises a connection part 42 adapted to be mounted on the edges of the door plate members 20 in such a manner that a closed tube-shaped profile part 44 of the sealing strip member 42 is placed along the edges of the outer surfaces of the door plate members 20.

The door plate member 20 is provided with upper bracket members 46 by which the door plate member 20 may be supported on the upper side edges of the treatment tank 2.

Figure 7:
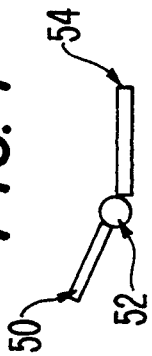
FIG. 7 is a partial end view of the door seal latch bar of FIG. 6.
Figure 8:
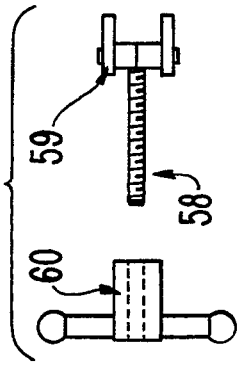
FIG. 8 is an exploded view of a clamping member for the tank of the present invention.
Figure 6:
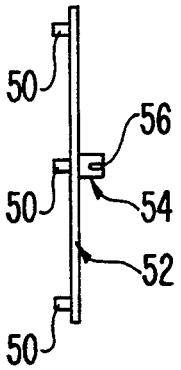
FIG. 6 is a side view of a door seal latch bar for the tank of the present invention.

The door plate member 20 is, on an outside surface thereof, provided with three horizontally placed parallel squared tube members 48, the opposite open ends of which are inclined for easy reception of an outer free end of the locking latches 50 projecting from a vertical mounted door seal latch bar 52 (FIGS. 6, 7), which opposite the locking latches 50, has a centrally projecting clamp latch 54 provided with a central slot 56 adapted to receive a clamping bolt 58, a base end of which is journalled between brackets 59 (FIG. 8) secured to outside corners of the treatment tank 2. Outside the clamping latch 54, the clamping bolt 58 cooperates with a door lock handle generally designated by the reference numeral 60 (FIGS. 1, 2, 8) by which the door seal latch bar 52 may be rotated around its vertical axis for pulling the door plate members in order to establish a water-tight sealing engagement between the tube-shaped part 44 of the sealing strip members 40 and the engagement flanges 26 of the treatment tank 2. The door plate members 20 have vertical handles generally designated by the reference numeral 49 between the two upper tube members 48.

Prior to filling the treatment tank 2 with warm water at a temperature of about 38°–40° C., it may be necessary to move the treatment tank 2 with the down cow located therein to a location accessible to warm water and a location where the ground is level and soft. In this connection, it is rather important that the cow has an extremely good footing when exiting the treatment tank 2 so that the cow does not slip or do the split. If necessary, to move the treatment tank 2 with the down cow in it, the trailer tongue system 10 is again lowered in order to lift the treatment tank 2 to its transport position and, of course, the locking pins are again inserted into the locking holes 16 for securing the treatment tank 2.

Figure 14:
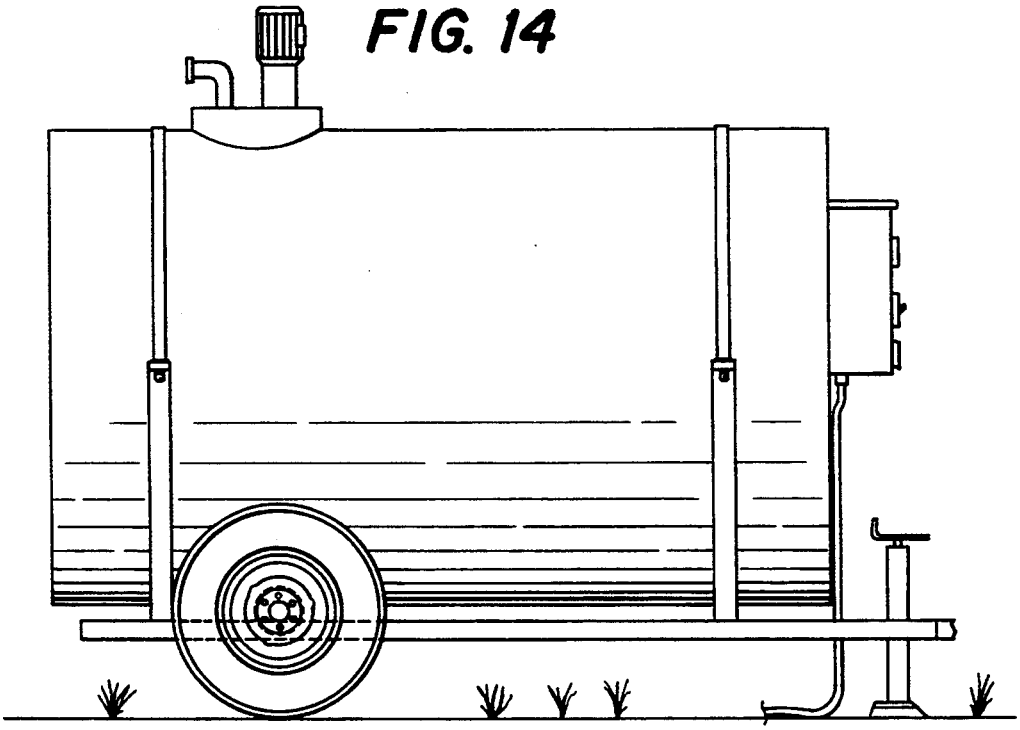
FIG. 14 is a schematic view of a wheel-supported boiler tank for producing warm water on site for the treatment tank of the present invention.
Figure 15:
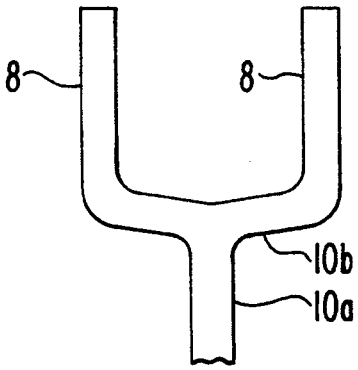
FIG. 15 is a partial schematic view of the draught system of the present invention.

Alternatively, if the treatment has to take place in a location without supply of warm water, a special water boiler mounted on a separate trailer (FIG. 14) may be used. A halter is put around the head of the cow to assist the cow in keeping her head above the water while filling the tank 2. When ready, the treatment tank 2 is filled with warm water, for example, up to about a hip of the cow. The warm water will help the muscles and stimulate the blood circulation. The cow must stay in warm water for about six-seven hours.

After the treatment, the water may be slowly drained out of the treatment tank through an outer valve 62 (FIG. 1) so that the cow can get accustomed to her normal weight. The outlet valve 62 is arranged just above a bottom surface 22 of the treatment tank 2. It may be advantageous to permit the cow to stay in the empty treatment tank 2 for about one hour before again removing the door plate members 20 to permit the cow to exit the treatment tank 2 by herself.

If the cow goes down while the water is draining or after the draining is finished, and the cow must remain inside the treatment tank for another eight hours, a feeding of the cow in the treatment tank 2 prior to filling the tank again with warm water is necessary.

Prior to permitting the cow to exit the treatment tank 2, it is necessary to remove the back door plate 20 and milk the cow, if necessary, and subsequently replace the back door plate member 20 when milking is finished.

The exit of the cow from the treatment tank 2 must be very slow and controlled. For this purpose, the front door plate member 20 should be removed so as to permit the cow to slowly exit the treatment tank 2. For a more controlled exit, special rails are recommended at each side of the treatment tank 2. If the cow once again goes down, the cow should be allowed to rest for a while before the cow is again put back into the treatment tank 2 for another treatment.

Figure 13:
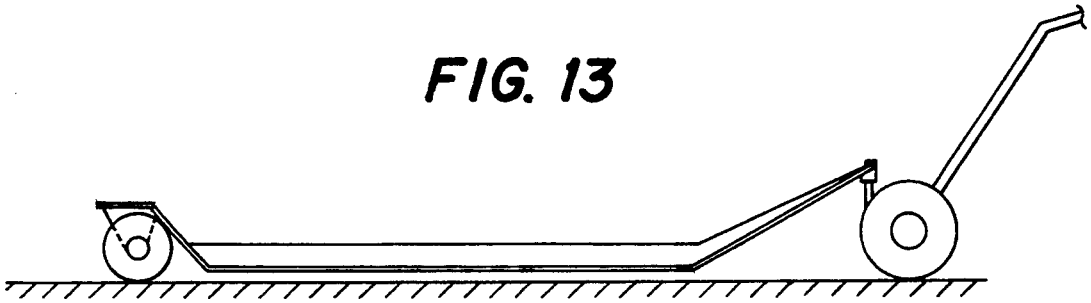
FIG. 13 is a schematic view of a stretcher for fetching down cows out of a cattle shed.

If the cow goes down inside a cattle shed, a special stretcher (FIG. 13) may be used to bring the cow out into the open before beginning the treatment.

I claim:

1. A method for treatment of large down animals which, due to a physiological disorder are unable to raise themselves, the method comprising the steps of:

placing a drag mat next to the down animals, moving the animal onto the drag mat, providing a treatment tank built on a trailer in a pivotal manner such that the treatment tank may assume either a transport position wherein the tank is lifted free from the ground or a working position where the tank is supported on the ground and having removable doors at opposite ends thereof, positioning the treatment tank with the doors removed in front of the cow in such a manner that a ramp of the treatment tank is placed nearest a head of the down animal, pulling the drag mat with the animal thereon by a tractor or a truck into the treatment tank, replacing the end doors so as to water-tightly seal the treatment tank, and filling the treatment tank with warm water for assisting the animal in raising itself.

2. A method according to claim 1, further comprising the step of moving the treatment tank with the down animal therein to a location where the ground is level and pivoting the treatment tank from the transport position to the working position.

3. A system for treating large animals which are unable to raise themselves, the system comprising a treatment tank built on a trailer in such a manner that the treatment tank is pivotable to either a transport position in which the tank is lifted free from the ground or a working position in which the tank is supported on the ground by supporting wheels, a drag mat adapted to be placed on the ground next to the down animal for rolling the down animal onto the drag mat, a ramp adapted to be placed in front of a head of the down animal between a ground surface and a narrow end edge of a plane bottom surface of the treatment tank, door openings provided at opposite narrow ends of the treatment tank, door plate members removably mounted in the respective door openings for water-tight sealing of the treatment tank when the animal on the drag mat is pulled into the treatment tank, and valve means for discharging water from the treatment tank subsequent to treatment of the large animal, wherein the supporting wheels of the treatment tank are mounted on girders forming a part of a trailer draught system in such a manner that the wheels are positioned at a distance in front of a pivot axis for rearmost ends of said girders, and wherein front ends of the girders are connected by a cross bar with a central connection bar adapted to be coupled to a tractor or truck, and wherein fixing means are provided between said girders and tank sides to secure the girders either in said working position or in said transport position.

4. A system for treating large animals which are unable to raise themselves, the system comprising a treatment tank built on a trailer in such a manner that the treatment tank is pivotable to either a transport position in which the tank is lifted free from the ground or a working position in which the tank is supported on the ground by supporting wheels, a drag mat adapted to be placed on the ground next to the down animal for rolling the down animal onto the drag mat, a ramp adapted to be placed in front of a head of the down animal between a ground surface and a narrow end edge of a plane bottom surface of the treatment tank, door openings provided at opposite narrow ends of the treatment tank, door plate members removably mounted in the respective door openings for water-tight sealing of the treatment tank when the animal on the drag mat is pulled into the treatment tank, and valve means for discharging water from the treatment tank subsequent to treatment of the large animal, wherein the treatment tank is provided with mutually parallel and upright side walls which at opposite end edges are provided with sealing means, said door plate members at opposite end edges are provided with sealing means, and locking means are provided at both ends of the treatment tank and, at both sides thereof, said locking means include a substantially vertical latch bar which, at one side, has a centrally projecting latch with an open slot adapted to receive a tightening bolt, an end part is pivotally secured at an outer side of the treatment tank, a threaded free end of the tightening bolt is provided with a locking handle by which the latch bar may be rotated about its own axis, said latch bar, at an opposite side, comprises a plurality of projecting latches adapted to be inserted into open ends of outer transverse profile members of the door plate members so that said sealing means at respective side edges of the respective door plate members by the locking handle may be forced against said sealing means at the respective end edges of the treatment tank.

* * * * *